United States Patent [19]

Urquhart

[11] Patent Number: 4,748,600

[45] Date of Patent: May 31, 1988

[54] INTERACTIVE DRUG DISPENSER

[75] Inventor: John Urquhart, Palo Alto, Calif.

[73] Assignee: Aprex Corporation, Palo Alto, Calif.

[21] Appl. No.: 80,344

[22] Filed: Jul. 31, 1987

Related U.S. Application Data

[63] Continuation-in-part of Ser. No. 899,412, Aug. 22, 1986.

[51] Int. Cl.[4] ..... G04B 47/00; G07F 11/00

[52] U.S. Cl. ..... 368/10; 221/2; 221/15

[58] Field of Search ..... 368/10, 107–113; 221/2–8, 15; 340/309.15, 309.4; 364/569

[56] References Cited

U.S. PATENT DOCUMENTS

| | | | |
|---|---|---|---|
| 4,361,408 | 11/1982 | Wirtschafter | 368/10 |
| 4,483,626 | 11/1984 | Noble | 368/10 |
| 4,504,153 | 3/1985 | Schollmeyer et al. | 368/10 |

*Primary Examiner*—Vit W. Miska

*Attorney, Agent, or Firm*—Ciotti & Murashige

[57] ABSTRACT

An interactive drug dispenser which actively controls the pattern in which doses of one or more pharmaceutical preparations are administered to a patient. The dispenser is programmed with information concerning an initial dosing regimen, and monitors deviations from that regimen. The dispenser is adapted to calculate from the dosage deviation a dosing error correction factor which corrects a patient's measured plasma drug concentration for deviations from a prescribed dosing regimen, so as to distinguish the effects of patients' dosing errors from suboptimal prescribed dosage regimens.

27 Claims, 10 Drawing Sheets

INTERACTIVE DRUG DISPENSER

CROSS-REFERENCE TO RELATED APPLICATIONS

This application is a continuation-in-part of U.S. application Ser. No. 899,412, filed Aug. 22, 1986.

BACKGROUND OF THE INVENTION

1. Field of the Invention

This invention relates to the dispensing of pharmaceutical preparations. More particularly, the invention relates to an interactive drug dispenser, including a means for actively controlling the pattern in which doses of one or more pharmaceutical preparations are administered to a patient. The device further includes an improved means for therapeutic drug monitoring.

2. Description of Background Art

When a physician prescribes medication in a nonhospital setting or when an over-the-counter medication is sold, substantial reliance is placed on the patient to comply with the dosing instructions. Unfortunately, even in the case of acute illness, patient compliance with the prescribed dosing regimen is often casual or negligent. This can lead to misinterpretation by persons monitoring the patient's progress regarding the severity of the diseases, the effectiveness of the prescribed dose of drug, or the effectiveness of the drug itself, at any dose.

A number of devices have been proposed heretofore as aids to reliable self-medication. These include:

passive medication containers that segregate medicines according to the times they should be taken (for example, the dispensing packages in which birth control pills are marketed);

medication dispensers that provide clock-actuated alarms (see, for example, U.S. Pat. Nos. 3,651,984 to Redenbach and 4,419,016 to Zoltan);

medication dispensers from which the patient can receive medication only within certain time intervals (see, for example: U.S. Pat. Nos. 3,722,739 to Blumberg; 3,762,601 to McLaughlin; and 3,815,780 to Bauer);

medication dispensers designed for general use in therapeutics, lacking specifications peculiar to particular pharmaceuticals (see, for example, U.S. Pat. No. 3,911,856 to Ewing); and medication dispensers that record the times at which the patient removes medication (see, for example: U.S. Pat. No. 4,034,757 to Glover; 4,360,125 to Martindale et al.; and 4,504,153 to Schollmeyer et al.).

Other references relating to this general subject include the following: U.S. Pat. Nos. 3,369,697 to Glucksman et al.; 3,395,829 to Cogdell et al.; 3,917,045 to Williams; 3,968,900 to Stambuk; 3,998,356 to Christensen; 4,207,992 to Brown; 4,223,801 to Carlson; 4,258,354 to Carmon et al.; 4,275,384 to Hicks et al.; 4,361,408 to Wirtschafter; 4,367,955 to Ballew; 4,382,688 to Machamer; 4,448,541 to Wirtschafter; 4,473,884 to Behl; 4,483,626 to Noble; 4,490,711 to Johnston; and 4,526,474 to Simon.

These prior art devices are sometimes helpful aids for improving the reliability of self-medication. However, implicit in these devices is the assumption that dosage regimen and patient condition are unchanging. In the reality of everyday therapeutics, however, both the prescription of drugs and the self-administration of drugs are subject to many contingencies, including, but not limited to:

changes in the course or nature of the patient's disease;

changes in the overall reliability with which the patient takes a given medication;

particular circumstances that may arise which will prevent the patient from faithfully following the prescribed regimen (e.g., having no access to water, being preoccupied by other business, having previously exhausted the medication supply, or being in a social situation where self-administration of drugs would be embarrassing);

changes in the patient's physiological mechanisms of drug absorption, distribution, metabolism or excretion that necessitate changes in the dosing regimen; and the occurrence of acute nausea or vomiting that precludes the oral self-administration of a particular medication.

The present application is a continuation-in-part of U.S. patent application Ser. No. 899,412, filed Aug. 22, 1986, incorporated herein by reference. That application is directed to a contingent dosing device which is capable of directing in an interactive or contingent manner the dispensing of a sequence of pharmaceutical doses to a patient. The present invention relates to an improved method of therapeutic drug monitoring, and in a preferred embodiment is essentially an improvement of the contingent dosing device disclosed in the parent application hereto.

Therapeutic drug monitoring (TDM) refers to the practice of measuring the concentration of drug in a patient's plasma (or other biological fluid, e.g. saliva, urine, tear film, etc.) so as to select the dosage regimen of the drug that will maintain drug concentrations within the therapeutically optimum range. Typically, drugs subject to TDM have generally recognized upper and lower limits for drug concentration in plasma, so that optimization of the dosage regimen will maintain the drug concentration within those limits. Pharmacokinetic information on the drug in question can indicate to the prescribing physician how much to adjust the dosage regimen in order to bring suboptimal drug concentration into the optimal range. There are currently a number of drugs which are frequently monitored with commercial assays, and as clinical pharmacology progresses in its understanding of drugs, it is certainly foreseeable that more drugs will become the subject of TDM.

Proper interpretation of TDM values by a physician requires first of all a sensitive, specific and precise assay, so that the measured value accurately reflects the true concentration of the drug in the patient's plasma (or other fluid). However, even where a sufficiently sensitive and specific assay is available, there is a further problem in interpretation to which the present invention is specifically directed. This problem is that the proper interpretation of the measured concentration value strongly depends upon the patient's having accurately followed the prescribed dosing regimen in the days prior to the taking of the blood sample for TDM. If the patient has failed to do so, the drug concentration value will deviate from that which would be expected with proper dosing, and the doctor's decision regarding the need for dose adjustment may be based on a mistaken assumption as to the patient's having properly followed the prescribed dosing regimen. Or, if the doctor does not recognize that the patient has followed an incorrect regimen, his other decision to adjust the dose may be based on an incorrect assumption about the size and timing of doses actually taken by the patient. Thus, there are three quite different bases for a suboptimal TDM test result: (1) the incorrect dosing regimen taken correctly; (2) the correct dosing regimen taken incorrectly; or (3) the incorrect dosing regimen taken incorrectly. Further, those skilled in the art will recognize that certain combinations of this third possibility may result in an optimal TDM test result, though such result is a false basis for concluding that the patient is receiving optimal therapy, inasmuch as poor compliance with prescribed drug regimens is often inconsistent and irreproducible, day to day.

SUMMARY OF THE INVENTION

Accordingly, it is an object of the present invention to overcome the aforementioned disadvantages of the prior art.

It is another object of the invention to provide an interactive drug dispenser which facilitates the effective self-administration of drugs.

It is another object of the present invention to provide an interactive drug dispenser which includes an improved means for interpreting the results of therapeutic drug monitoring.

It is a further object of the present invention to provide such an interactive drug dispenser wherein the improved means for therapeutic drug monitoring includes a means for computing deviations from a prescribed dosing regimen, and further includes a means for correlating those deviations from the prescribed regimen with the measured concentrations of drug in plasma.

It is a further object of the present invention to provide an interactive drug dispenser capable of noting and storing other information related to the patient's program of drug therapy. In particular, this information can include the times at which samples are drawn from the patient or other monitoring tests are carried out. In this embodiment, the data so recorded and stored can be offloaded or used in the calculation of dosing error correction factors or the like.

It is still a further object of the present invention to provide an interactive drug dispenser capable of providing a physician with a dosing error correction factor (DEC factor) which, taken together with the measured drug concentration value, yields a computed regimen-standardized drug concentration value, corrected for errors in the patient's administration of the drug.

It is still another object of the present invention to provide a method of correcting measured drug concentration in plasma for a patient's deviation from a prescribed dosage regimen.

It is yet another object of the present invention to provide a method of determining the ideal or optimal drug concentration range in individual patients, rather than to rely on a population average concentration range, as is presently done.

Additional objects, advantages and novel features of the invention will be set forth in part in the description which follows, and in part will become apparent to those skilled in the art on examination of the following, or may be learned by practice of the invention.

In one aspect of the present invention, an interactive drug dispenser is provided which is capable of controlling in an interactive or contingent sense the dispensing of a sequence of pharmaceutical doses to a patient. The drug dispenser further includes a means for computing deviations from a prescribed dosing regimen and a means for correlating those deviations with the measured drug concentration.

In a preferred embodiment, the dispenser includes a time counter capable of recording one or more starting times and of measuring at least one elapsed time period from the one or more starting times. The dispenser also includes an electronic memory in which can be recorded a prescribed dispensing regimen (including information concerning the times for taking doses and information regarding acceptable deviations from the programmed times). The dispenser is provided with a means for recording the times that the patient requests the dispensing of a dose of the drug and a means for comparing the actual dispensing times with the prescribed regimen. In a preferred embodiment, as described in the parent application hereto, the dispenser compares the actual deviation from the prescribed regimen with the preprogrammed information on acceptable deviations and informs the patient whether a dose may be taken, or whether a special supplemental dose should be taken, i.e., if the patient requests a dose too early, the dispenser will indicate that a dose should not be taken, if less than or equal to the acceptable deviation, will indicate that a dose may be taken, and if within a certain range of greater deviation, it may, for certain drugs, indicate that a greater than usual dose be taken.

The dispenser is capable of providing the patient's physician with information relating to actual doses and dosing times, plus means of computing therefrom a dosing error correction factor to be provided to the patient's physician for use in dose adjustment. Alternatively, the dispenser itself may include microelectronic circuitry adapted to compute and display such a factor. This factor enables the physician to determine the actual drug concentration value that would have been found had the prescribed dosing regimen been followed correctly; this corrected value will hereinafter be referred to as the "regimen-standardized" drug concentration. Thus, the device enables the physician to base his or her decision regarding further treatment and/or medication on the knowledge of whether suboptimal TDM data should dictate a change in prescribed drug dosage, or an improvement in the patient's drug regimen compliance, or both.

In certain embodiments of this invention, as disclosed in co-pending U.S. patent application Ser. No. 899,412, the device can be connected to a gate or valve for controlling the dispensing of the dose. When so connected, the device will carry out its informing of the patient by either dispensing a dose of the drug, refusing to dispense a dose, or altering the dose of the drug which it dispenses. If desired, the initial dispensing regimen may be modified so as to accommodate deviations in the patient's drug requests or changes in the patient's condition. The device may also be equipped with microelectronic circuitry adapted to compute and display a projection of a patient's drug concentration in plasma.

In a particularly preferred aspect of this embodiment of the invention, it can serve to indicate specifically how the projected present concentration relates to the peak and trough concentrations that occur in the course of each dose cycle. It will be evident to those skilled in the art that this information will be useful to a medical professional who seeks to sample the patient's blood for diagnostic purposes, e.g., for therapeuptic drug monitoring, when it may be of advantage to take the blood sample at a salient point, such as the peak or the trough, in the cycle.

In a related beneficial feature of the present invention, it includes means for recording in the dispenser's memory when a blood sample was taken for purposes of measuring drug concentration. It will be evident that the precise documentation of that sampling time, together with the patient's actual dosing times as recorded in the dispenser, will permit the most accurate interpretation of the measured drug concentration values. It will also be evident that it is both convenient and economical to record the blood sampling time with the same device that compiles the record of dosing times, since each dose creates a cycle of drug concentration that fluctuates over a 2- to 8-fold range in the interval between one dose and the next.

In an additional aspect of the invention, a therapeutic drug monitoring method is provided. The method entails recording in a patient-portable memory unit a prescribed dosing regimen capable of later modification, determining the times when a patient requests to take a dose of the drug, comparing the actual dispensing times with the prescribed dispensing regimen, calculating the deviation of the actual dispensing times from the prescribed regimen, calculating from the deviation a dosing error correction (DEC) factor, and using the DEC factor to estimate the regimen-standardized value of drug concentration in the patient's plasma or other body fluid.

BRIEF DESCRIPTION OF THE DRAWINGS

In this specification and appended claims, reference will be made to the accompanying drawings in which

DETAILED DESCRIPTION OF THE INVENTION

Figure 1:
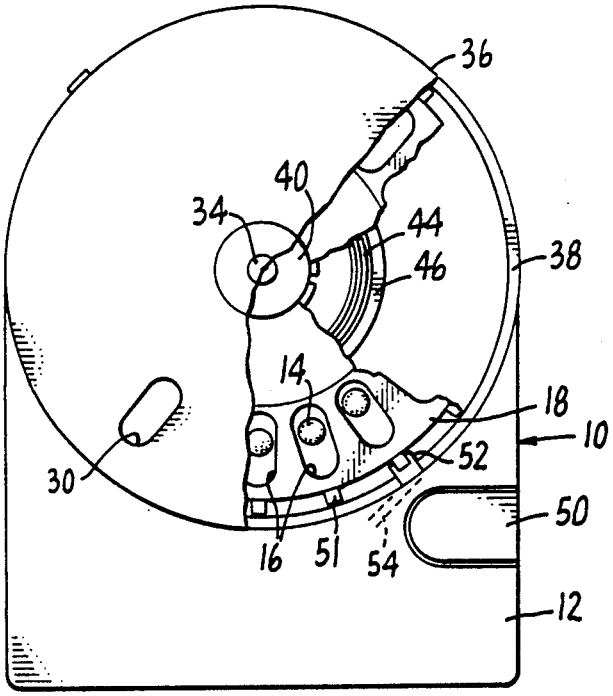
FIG. 1 is a partially cross sectional, top plan view of an interactive drug dispenser.
Figure 2:
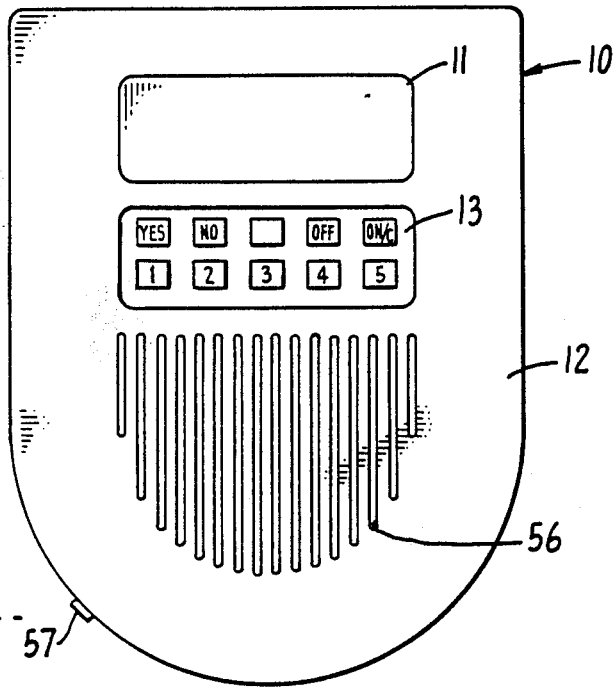
FIG. 2 is a bottom plan view of an interactive drug dispenser.
Figure 3:
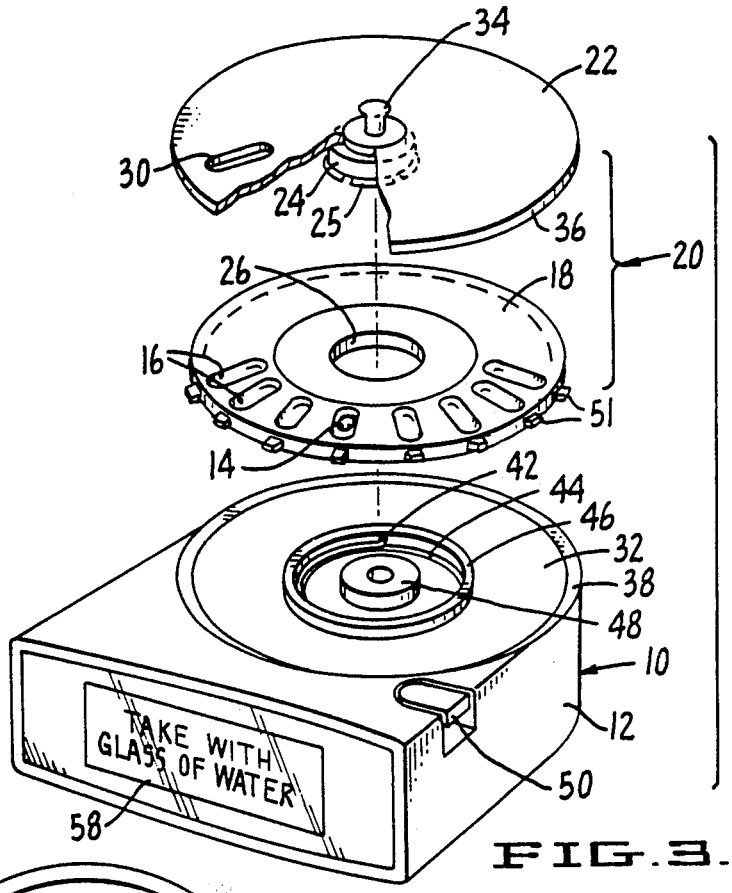
FIG. 3 is a perspective view of an interactive drug dispenser.
Figure 4:
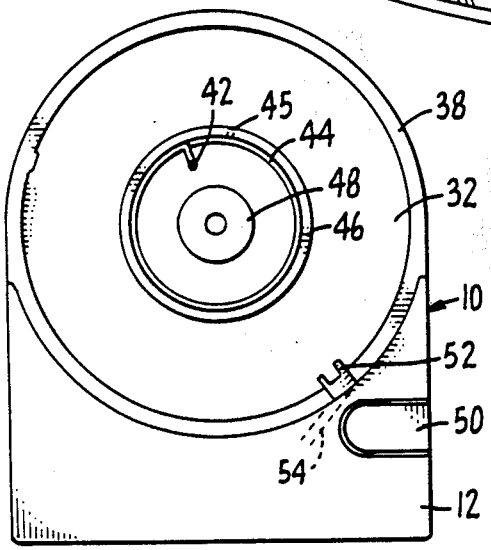
FIG. 4 is a bottom plan view of the carousel assembly.
Figure 5:
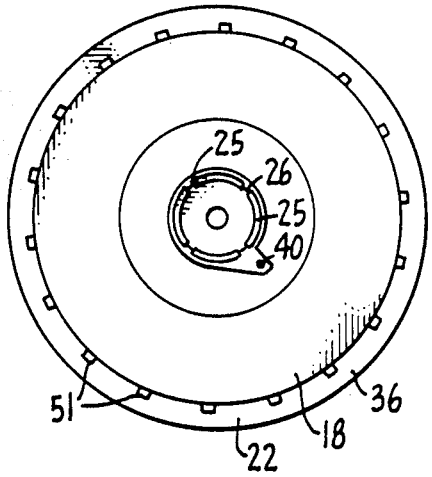
FIG. 5 is a top plan view of the device with the carousel assembly removed.

FIGS. 1 through 5 illustrate a preferred embodiment of the interactive drug dispenser. The dispenser is shown generally at 10, and includes housing 12 in which both the medication and the electronic circuitry of the invention are contained.

Unit doses of medication 14 such as tablets or capsules are provided within dosing compartments 16 located within and disposed around the circumference of rotatable circular base 18 of carousel assembly 20. Carousel assembly 20 also includes rotatable lid 22 aligned with and affixed to circular base 18 at its central section by means of retaining flanges 24 on base 18 protruding through central aperture 26 of lid 22 and gripping inner ridge 28 of the lid, which ridge, when carousel assembly 20 is in place on the dispenser, extends into the dispenser from base 18. Lid 24 is provided with dispensing port 30 which is adapted to align with compartments 16. As lid 24 is independently rotatable relative to base 18, dispensing port 30 may be aligned with any one of compartments 16 upon rotation of the lid. Thus, depending on the orientation of disk 20 relative to fixed base 18, medication in the dosing compartments may or may not be accessible.

Carousel assembly 20 is adapted to fit within recess 32 and may be removed therefrom by means of knob 34. When carousel assembly 20 is fitted within recess 32, perimeter 36 of lid 24 rests on peripheral wall 38 of housing 12, while outer ridge 38 of the lid is structured so as to fit within recess 32.

Inner ridge 28 of lid 24 is provided with wedge 40 extending outwardly from its perimeter. When the carousel assembly 20 is fitted within recess 32, wedge 40 is adapted to engage inwardly protruding end 42 of spring 44 coiled within circular enclosure 46 in recess 32. Upon insertion of the carousel assembly into recess 32, central aperture of base 18 accommodates upright retaining member 48 which extends upwardly from central recess 32.

Base 18 is provided with spaced apart ribs 50 disposed around the edge of the base's perimeter, each of which triggers sensor 52 as the base is rotated within recess 32. Sensor 52, designed to signal to the dispenser when a patient is requesting a medication dose (i.e., requesting access to one or more compartments 16 through dispensing port 30), is electronically activated when the patient requests a dose by pressing lever 54.

Response to the patient request again varies with the particular embodiment of the invention. The response may be an internally generated audio signal (heard by virtue of grating 56), a visual signal (message informing patient appearing on display screen 58) or a combination thereof.

Figure 6:
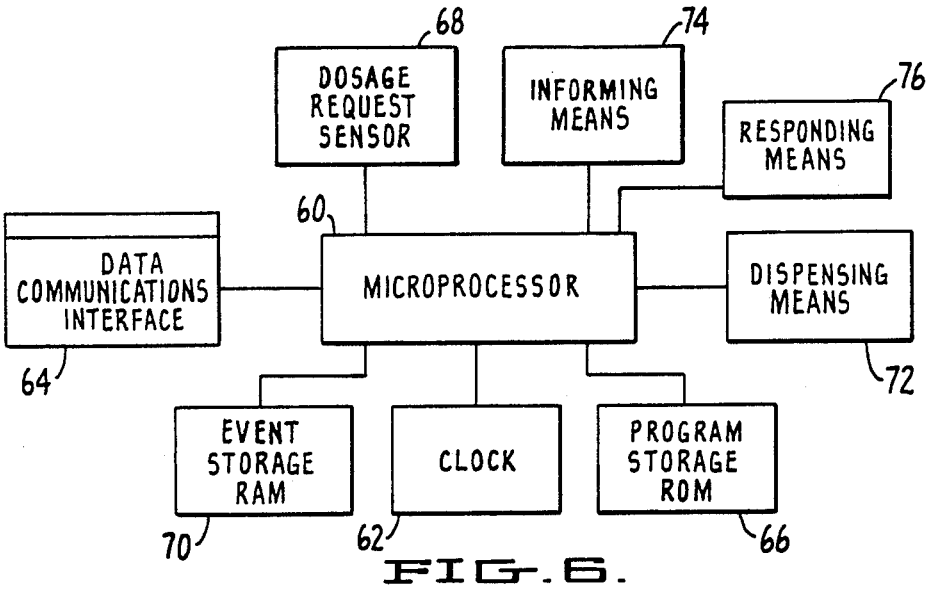
FIG. 6 is a functional block diagram of the circuitry within the dispenser according to embodiments of the invention.

FIG. 6 is a functional block diagram of the control circuitry of the dispenser. A microprocessor unit is provided which is the central logic unit of the dispenser. A clock, or time counter, is also provided which is capable of recording one or more regimen starting times and of measuring elapsed time periods therefrom. Information concerning a prescribed dosage regimen is entered by a pharmacist or physician through the data communications interface and stored in the PROM (an initial dosage regimen might be, e.g., four 50-mg doses at once, followed by one dose every three hours). The initial dosage regimen includes information relating to acceptable deviations from the programmed dosage times. When a patient requests a dose as outlined above, the dosage request sensor is activated, and the fact and time of the request may is stored in the event storage RAM. Based on the foregoing information, the dispenser will calculate the actual deviation of the time of the patient's request from the acceptable deviation as initially recorded. If the actual deviation is less than or equal to the acceptable deviation, a dose will be dispensed, and if the actual deviation is greater than the acceptable deviation, a dose will be withheld. If the dose is dispensed, a dispensing means will activate, e.g. in the embodiment outlined above, lid 24 would automatically rotate so as to align dispensing port 30 with a dosing compartment 16, thereby allowing the patient access to the drug.

Whether or not the actual deviation exceeds the acceptable deviation, the dispenser can optionally be provided with means to inform the patient as to the results of the comparison. An informing means such as an audio or visual signal (or combination thereof), or a time lock, will instruct the patient as to whether a dose may be taken at the time requested. For example, the dispenser may be provided with either an alphanumeric display or an electronically synthesized voice, or both, to permit communication with the patient.

In an alternative embodiment of the device, the informing means further includes: (1) a means for instructing the patient, e.g. to contact the patient's health care professional or to convey diagnostic information to that professional; and (2) a means for interrogating the patient as to the patient's condition. For example, if the initially prescribed regimen requires one dose every four hours, with an acceptable deviation, or window, of one-half hour on either side of the dose time, and a patient requests a dose two hours early, the dispenser will interrogate the patient as to the reason for the early request. The patient then responds through the data communications interface, and if, for example, the dose has been requested early because of pain or a worsening of the patient's disease state, the dispenser may inform the patient to contact the patient's health care professional. If the patient has requested an early dose accidentally, the patient may so inform the dispenser through the data communications interface and wait for the recorded dose time. If a patient has requested a dose two hours late, the dispenser may inquire, for example, if a pill was dropped or lost, or if undesirable side effects warranted putting off of the medication, etc. Again, the patient may respond through the data communications interface, either by suitable electrical switches and/or by electronic speech recognition, and the dispenser may either modify the regimen accordingly (e.g., in the case of an accidental late dose, modifying the entire regimen so as to shift all doses by two hours) or instruct the patient to contact his health care professional (e.g., where severe side effects are a risk) with, optionally, diagnostic information ascertained by the dispenser.

The informing means may be tailored to the amount of detail desired or needed by the patient, which may depend on the patient's understanding of the nature of his or her disease, on the nature and rationale of the various medications prescribed therefor, and on changes in the patient's familiarity with the content and style of the instructions. The informing means may also be designed so as to avoid consistently identical phrasing or otherwise repetitive instructions.

The instructing means may be in the form of an audio or visual message to the patient to call his or her health care professional. Alternatively, the instructing means may be such that the dispenser can contact the health care professional directly, such as by means of a radio transmission directly to the health care professional or indirectly, such as by triggering the sending of messages by telephone or the like from the patient's residence. This sending of messages can take the form of contacting a hierarchy of people depending upon the severity of deviation. For example, at the first stage the device could send a message to the patient himself to remind the patient to take a dose. At the next level in the hierarchy, the device could contact a predetermined family member, neighbor, or the like, to inform them to look in on the patient and correct the deviation. At a third level, the call could be made to a visiting nurse, paramedic or the like preappointed to intervene. And, in a fourth level, a physician, hospital or other health care professional could be contacted by the machine. All of the contacts could be carried out by transmitting taped messages, by sending encoded signals, or the like.

Optionally, the dispenser may be additionally provided with a means for modifying the initial regimen, either automatically or by the patient, physician, or pharmacist. For example, if a patient has requested a dose late, i.e., outside the acceptable deviation from the recorded dosing time, the dispenser may be programmed to shift the entire dosing regimen by the actual time deviation. Alternatively, the patient, physician, or pharmacist may reprogram the dispenser to effect therapeutically acceptable or desirable changes in the regimen. This capability of modifying the initial dosage regimen entails receipt by the dispenser and its contained logic unit of encoded radio signals, directing a change in regimen. To this end, the dispenser includes a means for receiving and decoding radio signals that have been especially encoded to maintain confidentiality and avoid mistaken activation due to receipt of unrelated radio signals.

The dispenser is also capable of operating as above based on the modified regimen. That is, the modified regimen will include information based on acceptable deviations from the dosing times as modified, so that dispensing of medication will be controlled by the dispenser as above for the initial dosing regimen.

The dispenser may also allow for the type and strength of drug loaded into the dispenser, which information could be included as part of the initial recorded dosing regimen. If a patient were to request an additional dose of a drug, or an early dose, the dispenser would thus take into account any difficulties that might arise as a result of a higher dose.

The time counter means of the present invention may, if desired, record the times at which a patient received each dose throughout a dosing regimen. Thus, a dosing record is created which is useful for later examination of patient compliance. Such a compliance monitoring system is clearly useful for a number of reasons, obvious to those skilled in the arts of therapeutics and medicine.

Optionally, the dispenser may include a means for informing the patient when a dose should be taken, e.g. by audio or visual means or both.

The dispenser of this invention will commonly be carried by the patient. This makes it a convenient place to record other information necessary for calculating DEC factors and the like. For example, times can be recorded in the device. These could include the times at which samples are drawn for essays or the times at which other measurements are made which relate to the pharmacokinetics of the particular drug in the particular patient. The means for inputting this information generally should be restricted to the health care professional. This may be done by equipping the device with a special input port and equipping the health care professional with a suitable interface. Alternatively, for example, one could use a special recessed key that could only be reached by the use of special tools or the like. Or, this information could be a computer-generated message fed by the health care professional into the device via an input port, using a special access code or password. Any of these methods allow the information relative to drug efficacy and pharmacokinetics to be stored and accessed in a single location.

In accordance with its utility in the field of therapeutic drug monitoring, the dispenser also includes a means for comparing the actual dispensing times with the prescribed dispensing regimen so that the dosage deviation from the prescribed regimen—in units of dose or time—may be derived for the prior period of time relevant to the measured concentration of drug (the 5-half-life interval, described below). The dispenser further incorporates a means for calculating a dosing error correction factor which may be used to compute a correction factor for assisting in interpretation of the measured plasma drug concentration, given the patient's deviation from a prescribed dosing regimen. That is, during a dosing regimen, when a physician monitors the concentration of drug in a patient's plasma, the physician will be able to use the DEC factor to calculate the regimen-standardized drug concentration, i.e., what the actual drug concentration would have been had the patient followed the prescribed dosing regimen correctly.

In one embodiment, the DEC factor may be ascertained in the physician's office by coupling the dispenser electrically or optically to a reader/display/-printer (RDP) module. The RDP module receives the information on actual doses and dosing times from the dispenser, and computes and displays the DEC factor. Alternatively, the dispenser itself may be provided with electronic circuitry adapted to compute and display the DEC factor.

The DEC factor is to be multiplied by the measured value of drug concentration in plasma to correct that measured value for the patient's deviation from the prescribed dosing regimen. The factor will be 1.00 if the patient had followed the prescribed regimen faithfully, while the factor would be greater than 1.00 if the patient had underdosed and less than 1.00 if the patient had overdosed. Dosing errors that materially influence the DEC factor are those that occur only during a certain interval of time prior to the time of blood sampling for TDM. That certain interval of time is equal to five times the terminal plasma half-life of the drug in question, and is conveniently referred to as the 5-half-life interval. As each drug has its characteristic terminal plasma half-life, the 5-half-life interval is drug-specific, and may be as little as, e.g., approximately 40 hours (in the case of a drug like theophylline, whose terminal plasma half-life is approximately 8 hours) or as long as, e.g., approximately 10 days (in the case of a drug like digoxin, whose terminal plasma half-life is approximately 48 hours). It is a recognized pharmacokinetic principle that dosing history—or, indeed whether any dosing occurred at all—before the 5-half-life interval has neglibible effect on the concentration of drug in a presently drawn blood sample.

Figure 12:
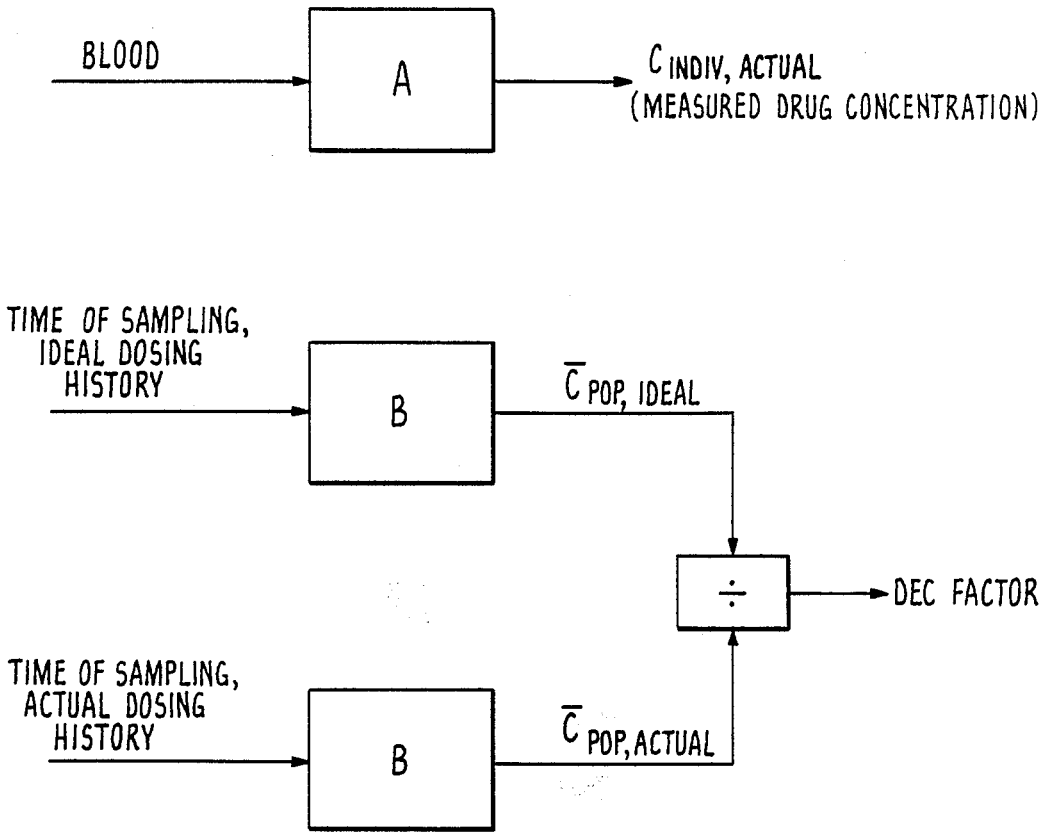
FIG. 12 illustrates the calculation of the DEC factor during a theophylline dosage regimen.

Reference is now made to FIG. 12, a flow chart which schematically illustrates calculation of the DEC factor. The scheme circumvents the problem that a physician rarely knows a patient's pharmacokinetic parameters. In modern drug development, however, physicians usually have a population-averaged pharmacokinetic model ("B" in FIG. 12). The ratio of the two predictions derived from the patient's pharmacokinetic model, that is, the ratio of the ideal drug concentration value to the actual, is a valid correction factor (DEC factor) for the individual, actual patient concentration ($C_{indiv,\ actual}$). Typically, though, ascertaining an individual patient's pharmakokinetic parameters requires an expensive series of tests—i.e., a series of $C_{indiv,actual}$ measurements made under a defined dosing regimen. The present method avoids this cost and complexity and simply uses the population model to determine a usually satisfactory approximation of a DEC factor and thus correct $C_{indiv,actual}$ to the ideal or regimen-standardized concentration value, $C_{indiv,ideal}$.

The significance of the regimen-standardized drug concentration, $C_{indiv,ideal}$, is that it demonstrates to the physician whether the prescribed dose should be raised or lowered (when $C_{indiv,ideal}$ is, respectively, too low or too high). If $C_{indiv,ideal}$ is within the acceptable bounds but $C_{indiv,actual}$ is outside those bounds, the physician's task is to improve the patient's compliance with the prescribed regimen. If $C_{indiv,ideal}$ is within acceptable bounds but $C_{indiv,actual}$ is too high, one may infer that the patient is overdosing. If, however, $C_{indiv,ideal}$ is within acceptable bounds but $C_{indiv,actual}$ is too low, it means the patient is omitting or delaying doses and is thus underdosing.

In FIG. 12, then,

"A" is the chemical analytic procedure;

"B" is the population pharmacokinetic model;

"C" is drug concentration value;

"$\bar{C}_{pop}$" is the average concentration predicted by the population pharmacokinetic model, either "ideal" as when the prescribed regimen was followed, or "actual" as when the recorded regimen was followed (said average is determined over a period of time corresponding to the 5-half-life interval prior to the concentration measurement);

"DEC Factor"$=(\bar{C}_{pop,ideal})/(\bar{C}_{pop,actual})$, so that $C_{indiv,actual}$x DEC Factor$=C_{indiv,\ ideal}$;

"Pop" represents population values;

"Indiv" represents individual values;

"Ideal" represents the regimen-standardized value that would obtain had the prescribed regimen been followed accurately;

"Actual" represents the concentration value that is produced by the dosage regimen actually followed by the patient during the 5-half-life interval prior to concentration measurement; and "/" represents simple division.

It should be noted that this method is an approximate means of correcting for dosing errors with drugs having linear pharmacokinetics, and may be an acceptable approximation for drugs with pharmacokinetics described by certain kinds of nonlinear models. Other nonlinear models will require a more complex mathematical analysis, or a table of DEC factors that vary according to the pattern or type of regimen error, as determined on a drug-by-drug basis.

Other options which may be incorporated into the interactive dispenser in alternative embodiments include the following.

In one case, the microcircuitry of the dispenser may be initially programmed so as to compute a running projection of the patient's drug concentration in plasma. That is, the initial information concerning the dosing regimen may be used to calculate the estimated concentration of drug in plasma throughout the dosing regimen. This information may be displayed to the patient on display screen 58, giving the patient a direct visualization of the consequences of correct or incorrect dosing.

The dispenser may also be programmed to display, together with the projected concentration values, the populational averages for upper and lower bounds of the concentration values. In this way, the patient can see that the dosing regimen is maintaining the concentration in the proper range or, possibly, that a delayed dose had allowed concentration to fall below the lower limit. The device may further be programmed to give a patient a choice of taking an extra dose by projecting the concentration values with or without the extra dose. This feature allows a patient to build a body of personal knowledge of his or her own upper and lower limits of drug concentration.

In still another embodiment of the invention, the dispenser can, via the data communications interface, interrogate the patient as to a menu of symptoms when drug concentration is estimated to be passing through certain critical values, e.g., maxima or minima. In such a way, the dispenser can ascertain correlational information with which to proceed with a formal analysis of drug concentration and drug effects, individualized to the patient's pharmacodynamic characteristics. The advantage of this procedure will be evident when one compares it to prior art, in which a physician may examine a patient at weekly or monthly intervals and rely on the patient's recall or notes the patient may have made in a diary about drug-related effects. A drug taken, e.g., twice daily will go through 14 cycles of variations in concentration in blood from peak to trough within a week, and 56 such cycles in the space of 4 weeks. Peak-related toxic drug effects and trough-related manifestations of insufficient therapeutic effect thus become blurred and difficult for the patient to recall and separately classify from memory that spans so many dose cycles. The distortions and inaccuracies of such memory recall for such repetitive events, even in the recent past, are described by Bradburn et al. in SCIENCE 236; 157–161, (1987). By interrogating the patient as to immediately present signs and symptoms, the interactive drug dispenser can compile a permanent record of signs and symptoms in a precisely defined temporal relation to drug dosing, with ample opportunity to build statistically firm pharmacodynamic correlations between drug concentration and drug effect. It is usually pointless and even counterproductive to bother the patient with questions regarding toxic effects before the drug concentration has peaked. Such questions can be put to the patient at the time the peak in concentration is projected to occur after each dose, and during several hours thereafter. An analogous clustering of questions regarding insufficient drug action can occur at and after troughs in drug concentrations. In this manner, the patient's pharmacodynamically individualized maximum and minimum drug concentration values may be ascertained, and the dosage regimen tailored accordingly, for optimum therapeutic use of the drug.

Currently, generally recognized concentration limits are population averages that do not necessarily reflect the limits that pertain to a given individual; the aforementioned feature allows the patient to replace the populational limits with his or her own specific, individualized limits.

In addition to its embodiment as various forms of drug monitoring devices, the present invention also encompasses a method of correcting measured drug concentration in plasma for deviation from a prescribed dosing regimen. The method includes recording in a patient-portable memory unit such as the program storage ROM of FIG. 7 information concerning a prescribed dosing regimen, the regimen comprising times for taking doses in a specified sequence as well as information regarding deviations therefrom. After this recording step, and after the start of the dosing regimen, the dispenser determines when a patient is requesting a dose, and compares the actual dosing times with the prescribed dosing regimen. Depending on the acceptability of the deviation from the actual dosing regimen, in accord with such a method a dose may or may not be dispensed. Here, the dispenser is additionally or alternatively provided with a means for deriving a dosing error correction factor as described.

The dispenser and method of the present invention thus minimize the risk of misinterpreted TDM values, facilitate the selection of an optimum dosing regimen for a patient, and give the patient a sense of direct participation in his or her drug therapy, thereby creating psychological conditions conducive to improved regimen compliance, improved correlation of drug dose with therapeutic and side-effects, and better drug therapy than present methods provide.

While the invention has been described in conjunction with the preferred specific embodiments thereof, the foregoing description as well as the examples which follow, are intended to illustrate and not limit the scope of the invention, which is defined by the scope of the appended claims. The following examples illustrate possible dosing regimens and contingencies which may arise during the regimens, to which contingencies the dosing dispenser of the invention responds to and accommodates. Reference will be had in these examples to the flow charts of FIGS. 8–10.

EXAMPLE 1

Digoxin—Mandated Regimen

Figure 7A:
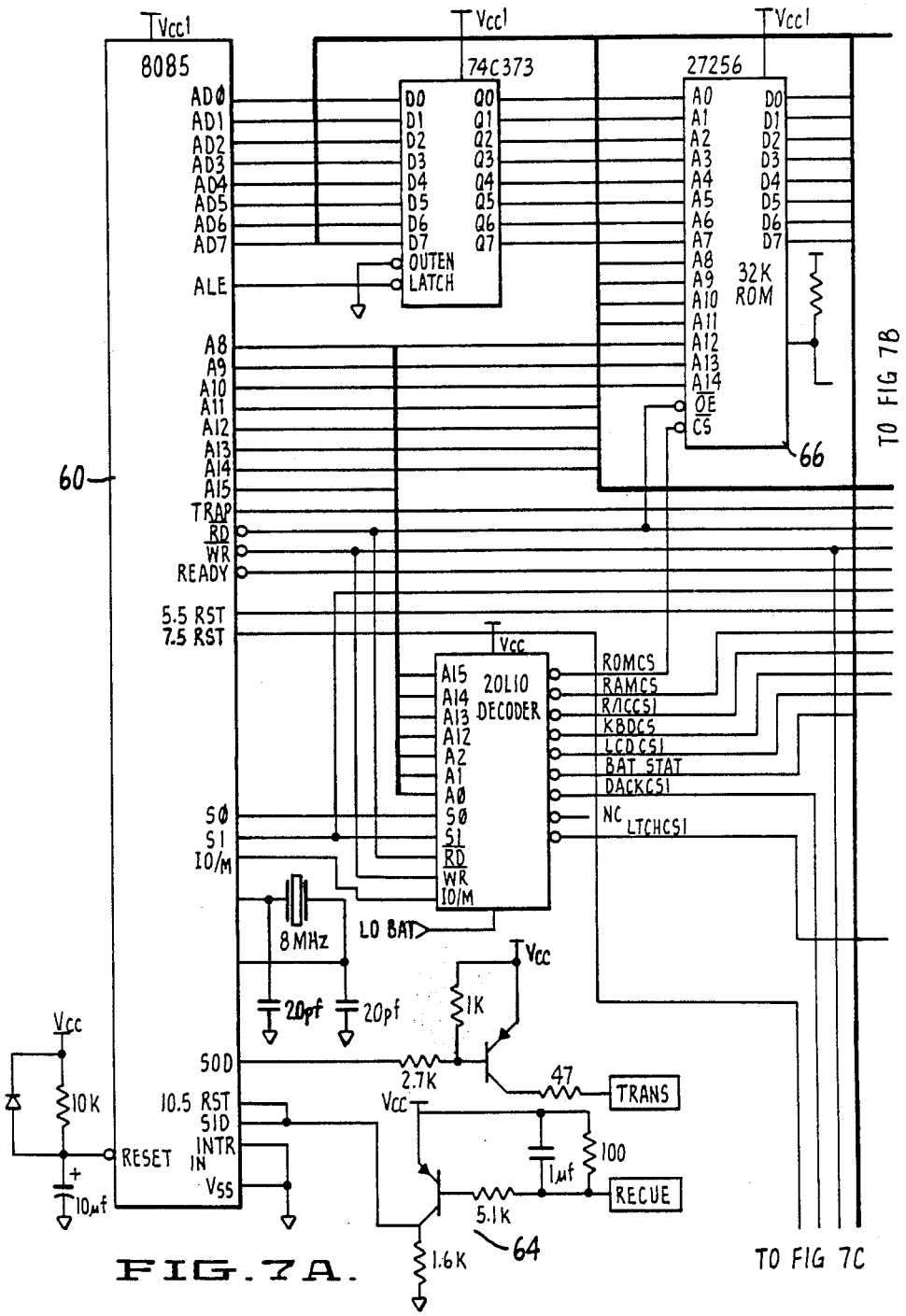
FIGS. 7A–7C illustrate the circuitry of a preferred embodiment of the interactive drug dispenser.
Figure 7B:
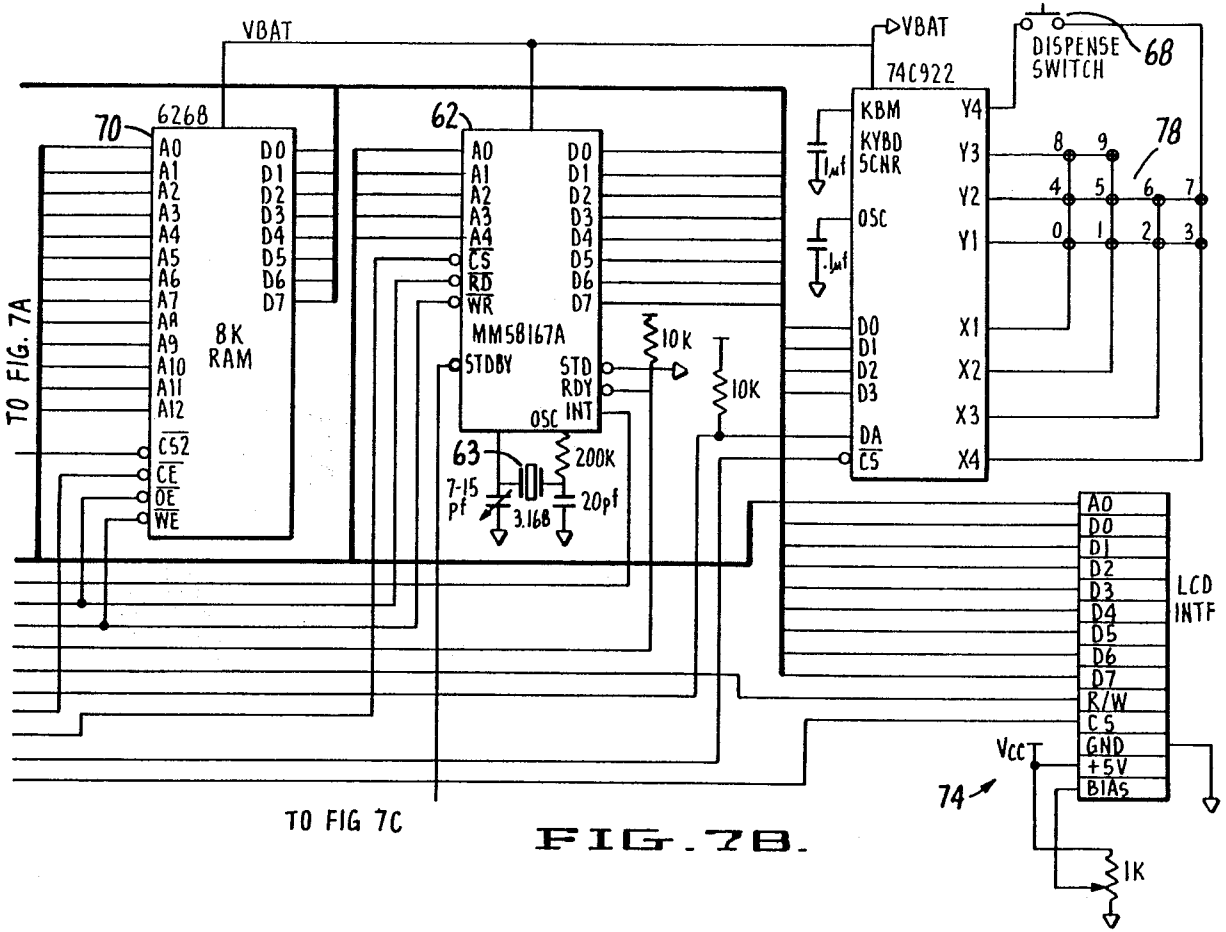
Figure 7C:
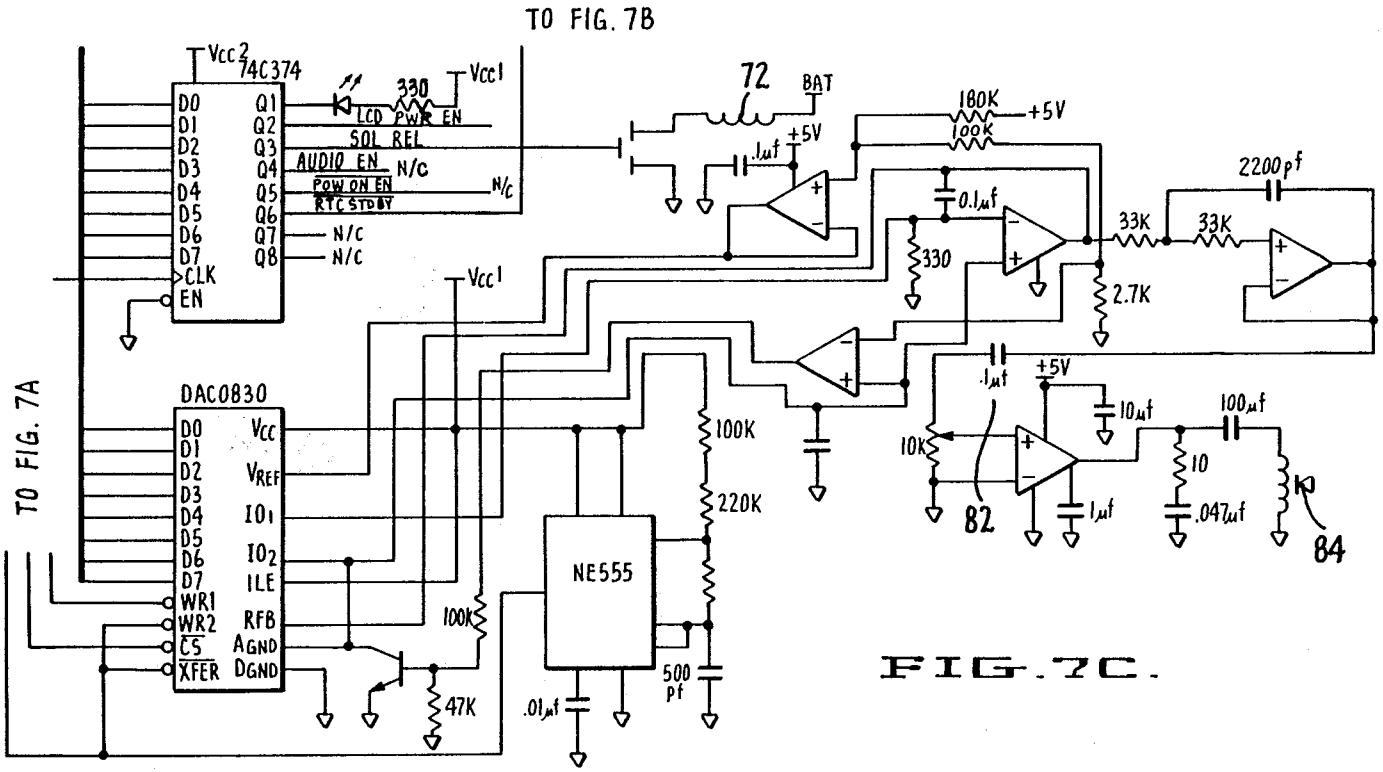

A digoxin regimen as accommodated by the dispenser of the present invention is illustrated in the flow chart of FIG. 7. An initial loading dosing regimen is provided for the first N doses, in which the number of tablets dispensed during that initial regimen is a function of N and time (t), $F_I$(N. t) and in which the number of tablets dispensed thereafter is a steady state regimen F(N, t) thereafter. After the initial request, the dispenser determines whether the number of the requested dose is less than or equal to N; if this is the case, $F_I$(N, t) tablets are dispensed, and the dispenser issues a message to take the dispensed dose with a full glass of water. If the number of the requested dose is greater than N, the dispenser goes on to analyze whether the elapsed time since the previous dose (t) is less than twenty hours. If so, the patient is instructed to wait 20−t hours before taking a dose; again, after 20−t hours, the patient is instructed to take that dose with a full glass of water. If more than 20 hours have passed, but less than 54 hours, F(N, t) tablets are dispensed, and the patient is again instructed to take the dose with water. If more than 54 hours have elapsed since the previous dose, the patient is instructed to call his physician, as the actual deviation has exceeded the programmed acceptable deviation—i.e., the patient is to take a dose between 20 and 54 hours after the previous dose.

EXAMPLE 2

Codeine—"As-Needed" Regimen

Figure 8:
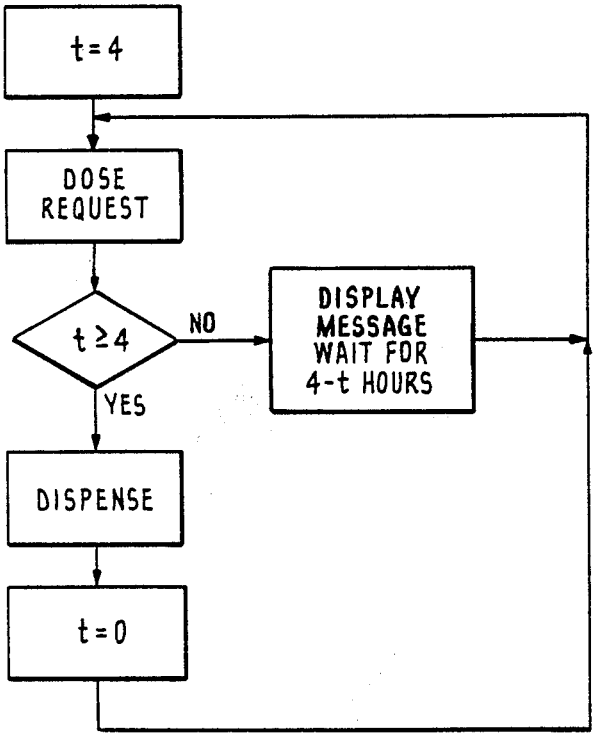
FIGS. 8, 9, 10 and 11 are flow diagrams illustrating examples of dosing regimens as controlled by the dispenser.

Reference is now had to the flow chart of FIG. 8. Here, one pill is to be taken no more often than every four hours as needed for pain. "t" is a register that keeps track of elapsed time and which may be set by the program to an arbitrary time. For example $t<0$ means reset the timer to 0 (t in hours). Initially, t is set to 4; a patient requests a dose, and the dispenser determines whether t is greater than or equal to 4. If not, the dose is refused, and the patient is instructed to wait for 4−t hours until taking a dose. If t is less than 4, a dose is dispensed and the timer is reset to 0.

EXAMPLE 3

Coumadin—Mandated Regimen

Figure 9:
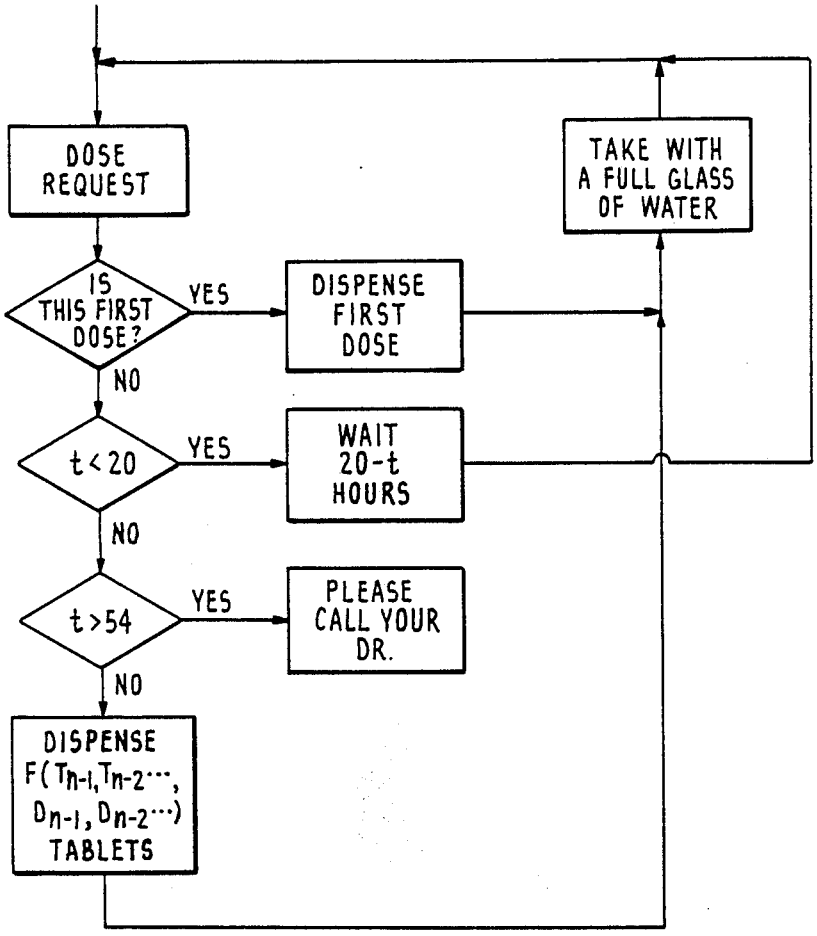

A coumadin mandated regimen is illustrated in the flow chart of FIG. 9. A preprogrammed first dose is administered followed by dosages determined by a function F which calculates the current dose based on the past n dosing times and amounts. No dose is dispensed in the patient has taken a dose within 20 hours or if more than 54 hours have elapsed since the patient took the last dose. In the latter case, the patient will be informed to call his doctor.

EXAMPLE 4

Tetracycline—A Mandated Regimen

Figure 10:
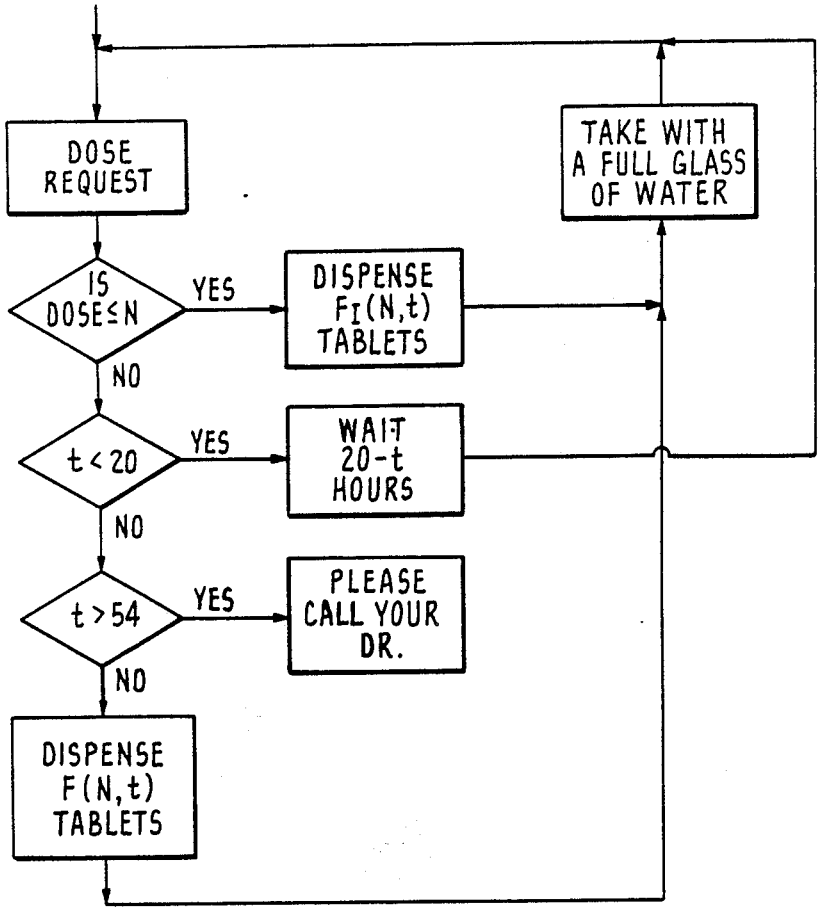
Figure 11:
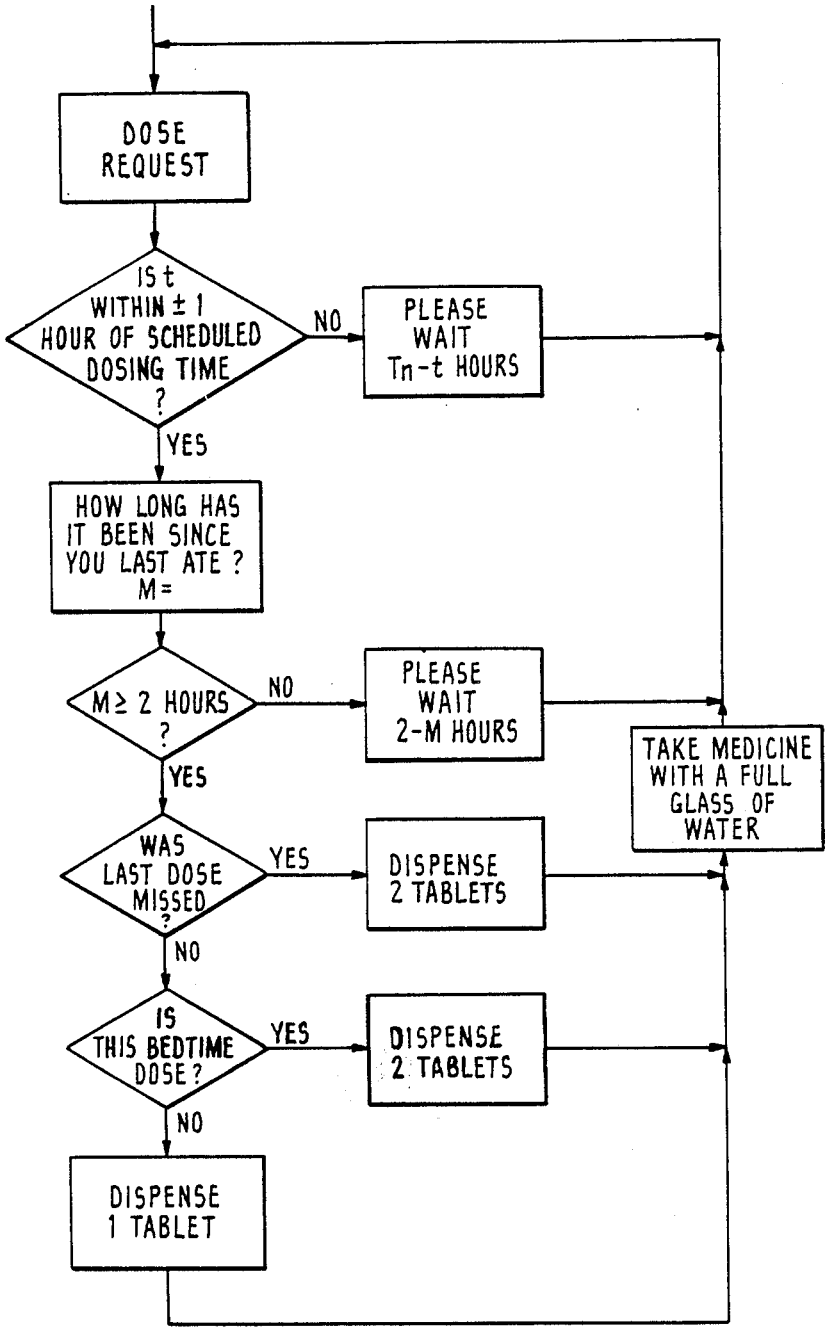

The flow chart of FIG. 10 illustrates a tetracycline regimen. One pill is to be taken four times a day, at least 30 minutes before or two hours after meals. If a patient misses a dose, then two capsules are to be taken at the next dosing time. Two capsules are also to be taken at bedtime. In no case should more than two capsules ever be taken at one time. The regimen allows for a two hour window around the scheduled dosing time, and instructs the patient to wait at least two hours after eating before taking a dose, or at least 30 minutes after dosing before eating.

EXAMPLE 5

Calculation of the DEC Factor—Theophylline a. A patient undergoing treatment for asthma receives maintenance doses of theophylline. The initial maintenance regimen is set at 450 mg of theophylline twice daily. In order to monitor drug concentration and effectiveness in this particular patient, a blood sample is drawn and theophylline concentration is measured. The measured value is 12 μg per ml. This is a value which is near the midpoint of the population average optimal range for patients receiving theophylline (10 to 20 82 g/ml). Thus, $C_{indiv,actual}$ here is 12 μg/ml, while from the population model one learns by simulation that $\overline{C}_{pop,ideal}$ is about 15 μg/ml. The recorded, actual dosing regimen, which the physician learns from the device itself, also yields a $\overline{C}_{pop,actual}$ of 15 μg/ml. The DEC factor, calculated according to FIG. 12, is thus 1.00. That is, $C_{indiv,actual}$ is equal to $C_{indiv,ideal}$, and it is unnecessary to correct the measured drug concentration for deviation from the prescribed regimen since the actual and ideal concentrations are equal and within the optimal range. It is also evident from these values and calculations that the patient's clearance of theophylline is 25% higher than the population average, but that the difference is insufficient to warrant a change in dose regimen.

b. The method of part (a) is followed, but the patient's concentration value is measured to be 7 μg/ml. This value is taken to be $C_{indiv,actual}$ as above. However, the dosing regimen actually followed by the patient has omitted doses such that the $\overline{C}_{pop,actual}$ is 9 μg/ml. Simulation also shows that $\overline{C}_{pop,ideal}$ is 15 μg/ml. Thus the DEC factor is 15/9=1.7 and the projected $C_{indiv,ideal}$ is 11.9 μg/ml. With this information the physician is alerted to try to improve the patient's compliance with the prescribed regimen, not to increase the prescribed dose, as the regimen-standardized concentration of 11.9 μg/ml is within the population average of optimal concentration range, namely, 10 to 20 μg/ml.

c. The method of part (a) is followed and the results of part (b) are obtained, but serial questioning of the patient by the dispenser has revealed that the patient sometimes experiences wheezing when the drug concentration falls below values computed to be 13 μg/ml, and that the patient sometimes experiences the central nervous or gastrointestinal symptoms characteristic of mild toxicity due to theophylline when the drug concentration exceeds values computed to be 25 mg/ml. Accordingly, the patient's dosage is increased by one-third to 600 mg twice daily, so that drug concentration better fits the patient's pharmacodynamically individualized optimal concentration range of 13 to 25 μg/ml.

What is claimed is:

1. An interactive drug dispenser for dispensing a drug to a patient, comprising:
   - a time counter capable of recording one or more starting times and of measuring at least one elapsed time period from the one or more starting times;
   - means for recording a prescribed dispensing regimen, said regimen including information concerning the times for taking doses in a specified sequence;
   - means for recording the actual dispensing times;
   - means for comparing the actual dispensing times with the prescribed dispensing regimen and deriving the actual deviation from the prescribed regimen; and
   - means for providing from the deviation a dosing error correction factor.

2. The interactive drug dispenser of claim 1, further comprising a means for controlling the delivery of the dose of the drug to a patient.

3. The interactive drug dispenser of claim 1, further comprising a means for recording the times at which a dose is requested.

4. The interactive drug dispenser of claim 3, further comprising a means for recording the times at which a dose is delivered.

5. The interactive drug dispenser of claim 1, wherein the dosing error correction factor is calculated so that the regimen-standardized drug concentration may be approximated from the measured concentration thereof.

6. The interactive drug dispenser of claim 5, wherein the measured concentration when multiplied by the dosing error correction factor gives the regimen-standardized concentration.

7. The interactive drug dispenser of claim 5, wherein the dosing error correction factor is provided by coupling the dispenser to a RDP module that computes and displays the factor.

8. The interactive drug dispenser of claim 7, wherein the coupling is electrical.

9. The interactive drug dispenser of claim 7, wherein the coupling is optical.

10. The interactive drug dispenser of claim 7, wherein the coupling is acoustic.

11. The interactive drug dispenser of claim 7, wherein the coupling is magnetic.

12. The interactive drug dispenser of claim 5, wherein the dispenser is programmed so as automatically to compute and display the dosing error correction factor.

13. The interactive drug dispenser of claim 5, wherein the dispenser is programmed to compute and display a continuing projection of a patient's drug concentration.

14. The interactive drug dispenser of claim 13, wherein the dispenser is further programmed to display the populational averages of actual drug concentration at a given point in a dosing regimen.

15. The interactive drug dispenser of claim 14, wherein the dispenser is further programmed to display the populational upper and lower limits of actual drug concentration at a given point in a dosing regimen.

16. The interactive drug dispenser of claim 13 wherein the continuing projection of the patient's drug concentration is presented in relation to the projected peak and trough concentrations that occur in the course of the dose cycle.

17. The interactive drug dispenser of claim 5, further including a means for computing and displaying the effect of a particular dosage deviation on plasma drug concentration.

18. The interactive drug dispenser of claim 5, wherein the prescribed regimen is modifiable.

19. The interactive drug dispenser of claim 14, further including a means for allowing the patient to input current information relating to specific physiological symptoms, whereby the information may be used by the physician to optimize the prescribed regimen.

20. The interactive drug dispenser of claim 19 wherein the means for allowing the patient to input current information includes means for interrogating the patient.

21. The interactive drug dispenser of claim 20 wherein the means for interrogating the patient affects the interrogation at times selected to correspond with projected maxima and minima in the drug concentration.

22. The interactive drug dispenser of claim 1, further including a means for contacting an individual in a hierarchy of people, said individual selected on the basis of said derived actual deviation.

23. The interactive drug dispenser of claim 1 further comprising means for recording the time the patient's blood is sampled for measuring blood levels of the drug being dispensed to the patient.

24. An improved interactive drug dispenser for controlling the dispensing of a drug to a patient, comprising:

a time counter capable of recording one or more starting times and of measuring at least one elapsed time period from the one or more starting times;

means for recording a prescribed dispensing regimen, said regimen including information concerning the times for taking doses in a specified sequence and information regarding acceptable deviations therefrom;

means for relating the start of said dispensing regimen to a time recorded or measured by the time counter;

means for determining when the patient requests to take a dose of the drug;

means for calculating the deviation of the actual dispensing times from the prescribed regimen; and means for informing the patient's health care professional as to said deviation;

wherein the improvement comprises providing a dosing error correction factor from said deviation.

25. A method of correcting measured drug concentration in plasma for deviation from a prescribed dosing regimen, comprising the steps of:

(a) recording in a patient-portable memory unit a prescribed dispensing regimen, said regimen including information concerning the times for taking doses in a specified sequence and information regarding acceptable deviations therefrom;

(b) determining the times when a patient requests to take a dose of a drug;

(c) comparing the actual dispensing times with the prescribed dispensing regimen and calculating the deviation of the actual times from the prescribed regimen; and (d) deriving from the deviation a dosing error correction factor.

26. The method of claim 25, wherein the dosing error correction factor is calculated so that the projected regimen-standardized drug concentration may be approximated from the measured drug concentration.

27. The method of claim 26, wherein the measured concentration when multiplied by the dosing error correction factor gives the projected regimen-standardized drug concentration.

* * * * *